US007520074B1

(12) United States Patent
Vanova

(10) Patent No.: US 7,520,074 B1
(45) Date of Patent: Apr. 21, 2009

(54) ARM COVER WITH INTEGRAL BANNER

(76) Inventor: Apolonia Vanova, 491 Everglade Crescent, London, Ontario (CA) N6H 4L3

( * ) Notice: Subject to any disclaimer, the term of this patent is extended or adjusted under 35 U.S.C. 154(b) by 0 days.

(21) Appl. No.: 11/938,324

(22) Filed: Nov. 12, 2007

(51) Int. Cl.
*G09F 21/02* (2006.01)

(52) U.S. Cl. ..... 40/586; 2/160; 2/161.1; 116/173

(58) Field of Classification Search ..... 40/586; 2/160, 161.1; 116/173, 63 P
See application file for complete search history.

(56) References Cited

U.S. PATENT DOCUMENTS

| | | | | | |
|---|---|---|---|---|---|
| 1,670,176 | A * | 5/1928 | Woolery | 116/35 R |
| 2,103,594 | A * | 12/1937 | Murray | 2/160 |
| 2,223,029 | A * | 11/1940 | Dunton | 2/160 |
| 2,534,313 | A * | 12/1950 | Starkey | 116/200 |
| 4,670,909 | A * | 6/1987 | Forrester | 2/160 |
| 4,805,242 | A * | 2/1989 | Bolton | 2/160 |
| 4,850,052 | A * | 7/1989 | Matthews | 2/160 |
| 4,905,321 | A * | 3/1990 | Walunga | 2/161.1 |
| 5,513,391 | A * | 5/1996 | Garneau et al. | 2/161.1 |
| 6,155,197 | A | 12/2000 | Stanley | |
| 6,233,742 | B1 * | 5/2001 | Yungkurth | 2/160 |
| 6,405,381 | B1 * | 6/2002 | Bowman, Jr. | 2/170 |
| 7,251,838 | B1 * | 8/2007 | Rumbaugh et al. | 2/160 |

FOREIGN PATENT DOCUMENTS

| | | |
|---|---|---|
| DE | 202006001365 U | 10/2006 |
| JP | 3059592 | 3/1991 |
| KR | 20030072822 | 9/2003 |
| NL | 1008190 C | 8/1999 |
| WO | WO2006126878 | 11/2006 |

* cited by examiner

*Primary Examiner*—Gary C Hoge
(74) *Attorney, Agent, or Firm*—Gottlieb, Rackman & Reisman

(57) ABSTRACT

An arm cover with an integral banner is presented that may be provided to sports fans, political fans, etch, as a novelty item. The arm cover includes a tubular member sized and shaped to comfortably fit over a person's forearm, wrist, hand and base of the fingers of a wearer. A banner is attached either temporarily or permanently to the tubular member and it can constitute a national/team flag, pennant, a logo, or provide other promotional information. In one embodiment of the invention, the banner is folded and tucked into a pocket or slit formed in the tubular member in order to hide it when it is not in use. The wearer can display the banner by pulling it out of the pocket or slit.

15 Claims, 14 Drawing Sheets

ARM COVER WITH INTEGRAL BANNER

RELATED APPLICATIONS

None

BACKGROUND OF THE INVENTION a. Field of the Invention

The present invention relates to articles of accessories in general, and more particularly to an arm cover with an integral banner, the cover including a banner with alphanumeric characters and/or images, colors, representing a flag, pennant, slogan, logo, etc., which associates to the forearm and/or wrist and/or hand and/or base of the finger(s) of a wearer.

b. Description of Prior Art

The present invention is concerned with an expressive arm cover with an attached displayable national or team flag, banner or pennant. The novelty sport or event accessory is designed for use by a spectator or participant of a sporting, social, political and other event in which the cheering, belonging to a group, rallying for a cause, celebrating of an event, expressing citizenship of a country, and other is signaled by releasing and waving of the flag and/or banner and/or pennant attached to the back or side section of the arm cover.

Sports enthusiasts and participants of different events have long sought novel and eye-catching ways of expressing loyalty to their team, country, social or political groups by bearing banners, pennants, wearing T-shirts and carrying hand held flags of various sizes attached to a plastic, metal or wooden stick like handle. The advent of formal licensing programs by sport teams at all levels of competition, both amateur and professional, along with the increased following of team sports by the general population and participating at different international events have resulted in a proliferation of flag, banner and pennant bearing products associated with sport teams, international sporting events like Olympics, political and other events. Organizations, including various profit and non-profit organizations use various types of novelty items bearing their name, logo, or a message for promotional purposes. These items can be sold or given away to fans and spectators at sporting events, at various events, such as parades, etc.

Hand held products that are sports or national team or other event oriented, most notably conventional team banners, pennants, flags or national flags, usually display the color or colors of the team, or national flag along with the coat of arms or logo and/or team name, slogan or other messages. They are popular items which are carried, cheered with and/or displayed by both spectators and participants of any event around the globe.

Participants of such events enthusiastically select and carry their hand held flag, banner or pennant holding it interchangeably in their left or right hand and therefore at all time occupying one hand. It is not uncommon to see a spectator/participant to put the flag under his/her underarm or hold it with his/her teeth in order to free his/her hand and be able to applaud the liking of a team action, event or to attend to a needy child, youngster or spectator. Loosing or misplacing of flags, banners or pennants is a normal occurrence at any public event and by such happening there is more contribution to environmental pollution as well. Further, holding of a flag handle, banner or pennant limits the participant's ability to hold a child's hand, beverage, purse, ticket or use his/her hand in case of securing his/her safety i.e. holding on to railing. The handle, which usually is a wooden, plastic or metal calls for exercising caution on the part of user not to touch, poke or hurt the person standing next to, in front of or behind him/her. It is not uncommon that in case of enthusiastic following and participating in cheering of the game or event the adult participant can accidentally poke himself/herself with the handle attached to the flag, banner or pennant.

However, most dangerous waving or carrying of flags, banners or pennants attached to a wooden, plastic or metal handle/stick occurs when children or young adults make use of such hand held device. There were and are thousands of medical emergencies because of unsafe use, carrying, waving of the hand held pennant displayed on a stick handle resulting in injuries some of them rather serious.

A number of handheld flags, banners or pennant devices still are and have been provided in the past for various purposes. For example: U.S. Pat. No. 6,155,197 entitled Retractable flag hand held unit, describes a hand held unit which retracts and extends a flag into a hand held housing.

The Korean patent application number: KR20020012038 entitled Frame flag describes a flag with an inserted steel wire which is embedded to form a frame on one plane, enables to use the flag for cheering at an event and to be held by one or two hands.

The Japanese patent number JP3059592 is entitled Hand Flag for Signal. The objective of this hand held flag invention is to distinctly discriminate red or yellow by the silicone compound paint film positioned on the outside surface of the flag body under illumination.

The German Patent number DE202006001365U Handheld flag consists of a length of textile with a hand-loop formed of e.g. a rubber band or a hook and loop fastening strap; The invented hand held flag and especially "rubber band or hook" attached to the wearer's hand is undesirable because it occupies the wearer's hand and especially his/her fingers. Further, the flag with the rubber band or a hook and loop fastening strap attached around the knuckles and/or fingers of the user renders the hand(s) of the user temporarily incapacitated. The use of the Hand-held flag with rubber band or a hook and loop fastening strap may be uncomfortable due to the strength of the rubber band or hook i.e. effecting the blood circulation of the user's hand and fingers. Moreover, if the rubber band or hook is to loose the flag may slip off the wearer's hand.

Dutch patent application number NL1008190C entitled Advertisement Pennant Fixed to Arm of a Sportsman, discloses plastic film or flexible fabric with a legend which is printed or woven onto the free flag part. The sleeve fits over the wearer's normal clothes and is secured with drawstrings, elastic or burr fastening strips.

PCT publication WO2006126878(A1) entitled Portable Optical Signalling Device, relates to an electronic portable device particularly to an item of clothing, a flag or torch containing a signaling component that can be switched between an initial state or a second state determined by the sensors.

With respect to forms of expression utilized by fans at sporting and social events, concerts and the like, fans and spectators often adorn themselves in a variety of ways. Conventional adornments include clothing Items such as t-shirts and jackets which contain the name or flag, banner or pennant of their selected team, national team, event or the like. At any rate, all of these forms of expression are designed to signify the wearer's support for their chosen team, country, band, player, event or the like.

While conventional sports team, national team and various event oriented hand-held flag, banner and pennant has tremendous market appeal, there is a need for a fresh and novel approach to flag, banner and pennant display demonstrating sports team, national team or community event loyalty. There is an unmet need for a novel safe to use flag, banner and pennant display for participants of any sporting or social event. There is an unmet need for easy to use and wear Arm cover with integral banner, flag or pennant on a wearer's hand, wrist and forearm in order to respond to safety, comfort and the ever growing all popular market demand.

SUMMARY OF THE INVENTION

The present invention is designed to provide a sporting spectator or any event participant with a safe-to-use, comfortable to wear, proud to display Arm cover with an integral banner. More particularly, the present invention provides an arm cover formed of a tubular member sized and shaped to be worn and to comfortably fit on the forearm, with at least one or more integrally attached banner, forming flag and/or pennant which can be easily displayed or stored by the wearer whenever he/she is at an event and enjoying the action. In one embodiment of the invention, the tubular member is formed with a rear opening and a front opening. The front opening being sized and shaped to allow some or all of the fingers and/or palm of the wearer to pass through, at the same time comfortably fit the contours or the wearers arm, wrist, palm, some or all knuckles and the base of some or all fingers near the knuckles. Moreover, in one embodiment, the tubular member is formed with a longitudinal slit that may be open permanently, or can be selectively closed. The banner is preferably attached to the tubular member along the slit, and can be selectively inserted through the slit when not in use. In one embodiment, an inner fabric as lining may be provided behind the slit or under the entire back of the hand part of the arm cover in order to form a pocket for the banner, flag or pennant.

In this manner, the arm cover described below in greater detail provides an accessory which not only conforms to the latest trend but most importantly it is comfortable and safe to use while the wearer is enjoying the chosen event. The accessory is preferably made of suitable fabric(s), two or more different fabrics and its surfaces are or may be provided with images and/or alphanumeric characters incorporating the colors of any national flag including a seal or coat-of arms where applicable and country name; describe an event such as the Olympics, a sport team including its colors and logos; names/words and/or logos associated with a profit or non-profit organization, any political or social event, etc.

DETAILED DESCRIPTION OF THE PREFERRED EMBODIMENT

Figure 1A:
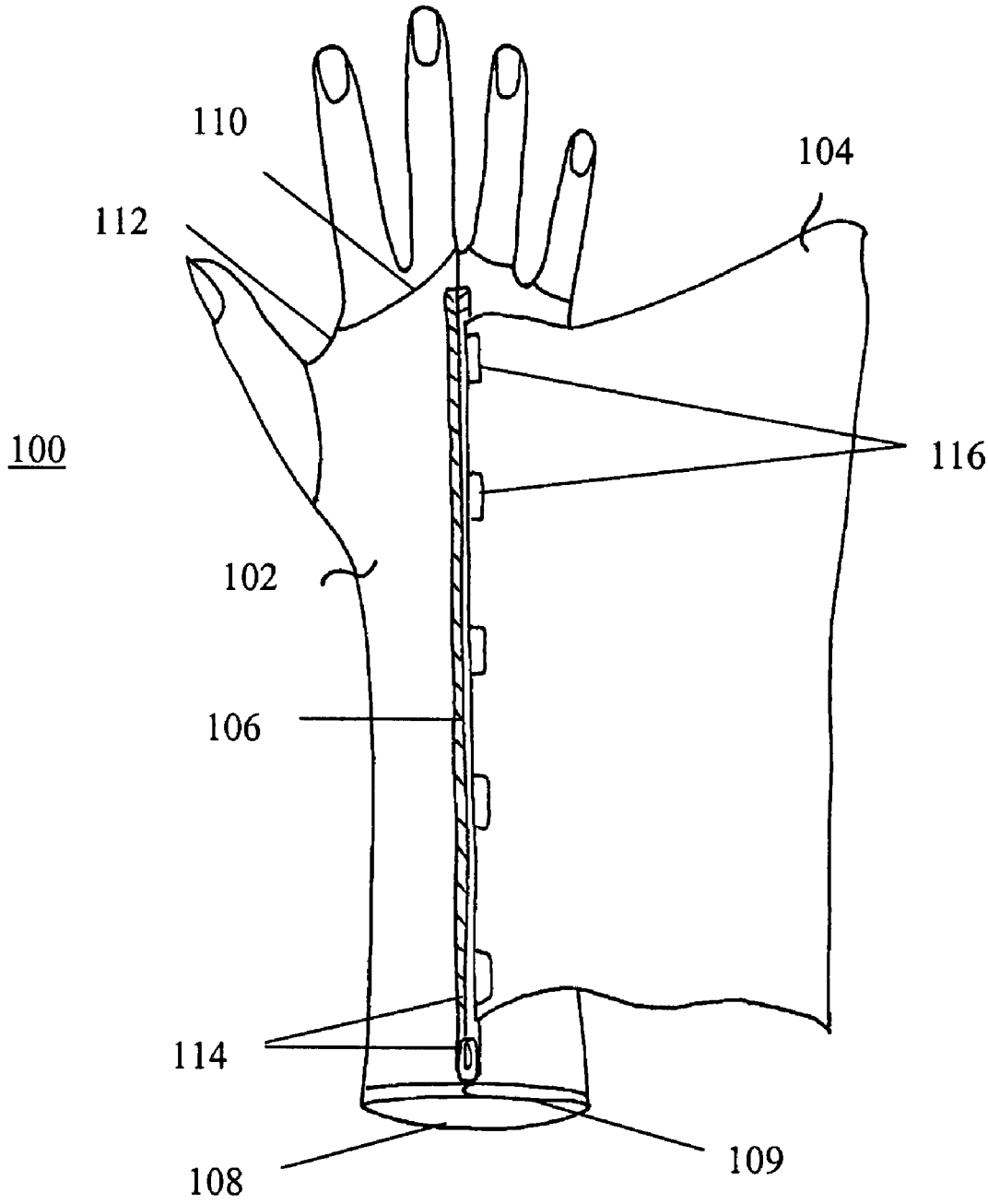
FIG. 1A shows a plan view of an arm cover constructed in accordance with this invention and worn on the forearm.

As shown in FIG. 1A, an arm cover 100 with an integral banner is formed of a tubular member 102 and a banner 104 attached to the member 102 along a longitudinal line opening 106. The longitudinal slit 106 may be closed with zipper 114 or other means of closing. The member 102 is sized and shaped to fit over the forearm of a wearer and is formed with a rear opening 108 and a front opening 110 so that the forearm can be inserted there through. Preferably the member 102 is long enough to extend from the elbow to the knuckles and base of the fingers, wrist or palm thereby providing support for a large banner 104. The front opening 110 is provided with extension 112 or other attachment means that fit around the thumb and/or fingers and/or palm of the wearer as discussed in more detail below. A Velcro® strap or 10 mm hem with suitable elastic or other tightening means 109 is used to comfortably tighten the opening 108 in the proximity just below the elbow of the wearer.

In one embodiment, the banner 104 is attached to the tubular member 102 along opening line 106. This can be accomplished by making the tubular member 102 of one fabric or two or more cuts of different fabrics and the banner 104 of another continuous fabric or more different fabrics. The provision means of attaching the banner 104 along line 106 may come about by techniques such as sewing, or a continuous or interrupted strip of Velcro® attachment 116, a zipper, different fastening devices i.e. snap fasteners, etc. The latter attachment means allow the banner 104 to be selectively removed from storage, cleaning, replacement, etc. Moreover, the arm cover can be provided as a kit with one or more tubular member 102 and one or more banners 104 that can be attached to each other in any number of combinations. The arm cover 100 is formed for the left or right hand or both hands in order to accommodate suitable thumb and finger openings. The manufactured left hand cover with a banner should be worn on a left hand and the manufactured right hand cover with a banner should be worn on a right hand. Moreover, the pair hand cover with a banner can be worn on one or both hands if selected by the user.

The slit 106 is long enough to allow a wearer to slip or tuck the banner 104 through the slit into the space between the tubular member 102 and the skin of the wearer which creates a cavity on the back of the wearer's arm. In another embodiment, a pliable fabric lining is attached to the member 102 behind the slit 106 to form a pocket for the banner 104. Further, the pliable fabric lining may be attached underneath the entire back hand portion of the arm cover in order to create a pocket as large as the entire arm cover on the back of the wearer's hand and arm. In one embodiment, the slit 106 is left opened. In another embodiment, closing means are provided to close the slit 106. The closing means may include 114 zippers, buttons, Velcro®, snaps, etc. Moreover, the closing means may be configured so that they also form the attachment means attaching the banner 104 to the tubular member 102. The above description is described for the right hand of the potential wearer.

Figure 1B:
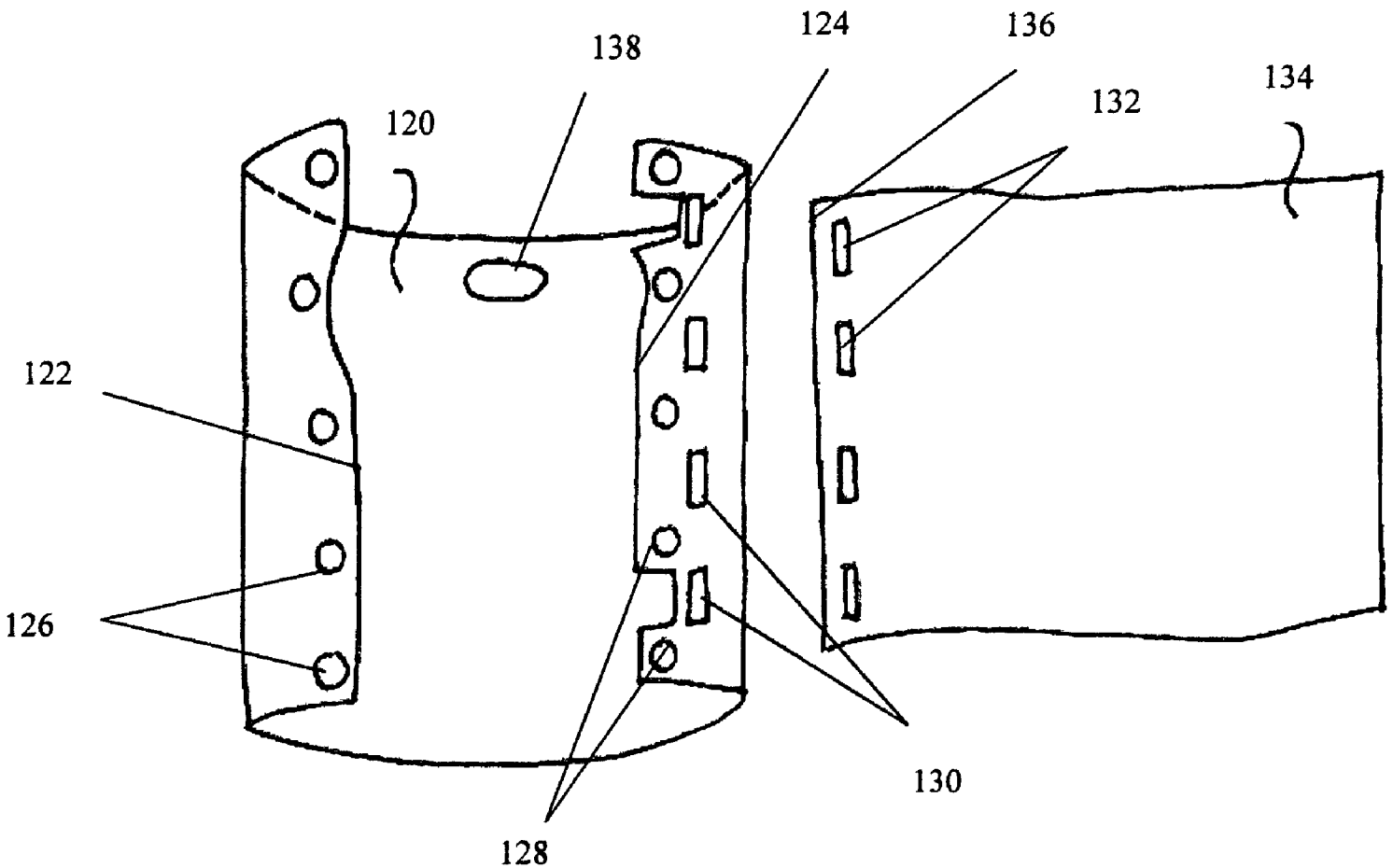
FIG. 1B shows two different sheets of fabric of two dissimilar content and weave that are attached together and can be shaped, folded or attached to make an arm cover with an affixed integral banner.
Figure 1C:
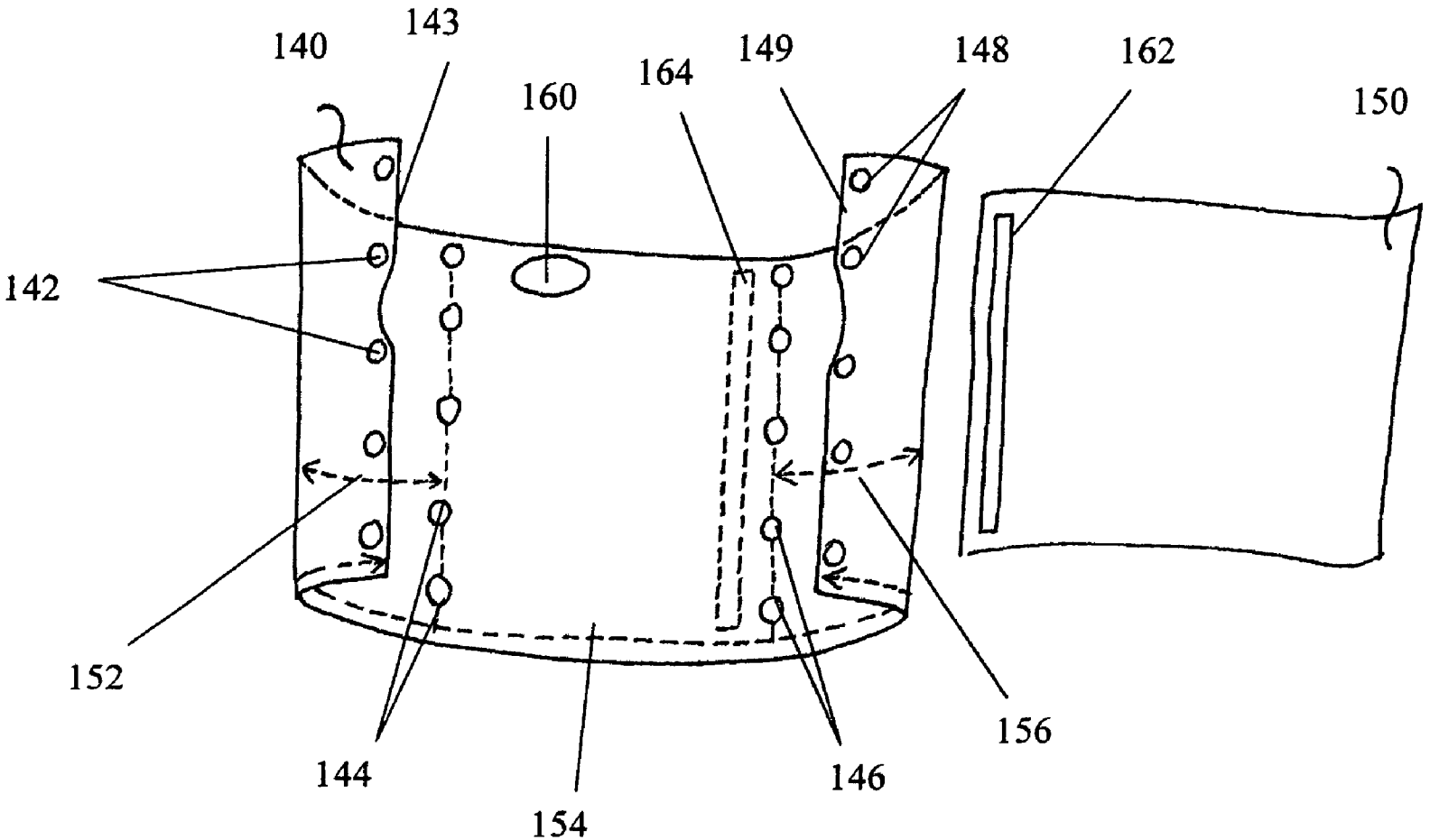
FIG. 1C shows another variation of two different sheets of dissimilar content and weave that are attached together and can be shaped, folded or attached to make an arm cover with an affixed integral banner.
Figure 1D:
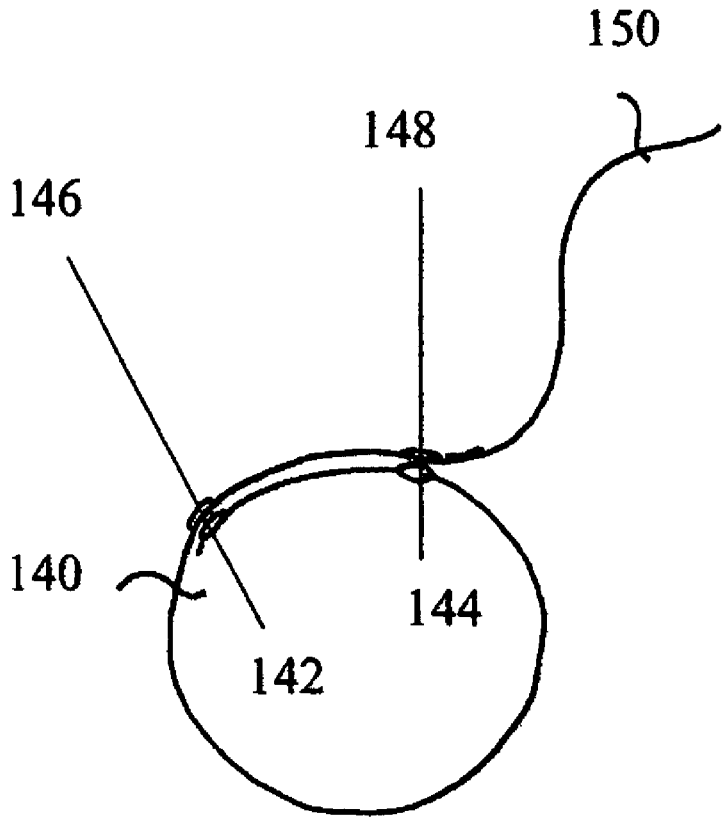
FIG. 1D shows a somewhat diagrammatic end view of the sheets of FIG. 1C folded to make the arm cover with an integral banner.

FIGS. 1B-1D show some typical configurations for implementing the invention in a different cut and configuration.

In FIG. 1B, a single sheet of fabric 120 is provided with two opposing lateral edges 122, 124. The fabric is provided with two sets of attachment or closing means, such as snaps, buttons, etc. The first set 126 is disposed along edge 122. The second set 128 is disposed along the opposing edge 124. There is another set of attachment means 130 along the fabric's outside edge 124 i.e. Velcro® or snaps between the second set of attachments 128 interchangeably attached for the purpose of attaching the 134 the banner. The sheet can be folded or rolled over with the attachments of set 126 engaging the attachments of set 128. In the proximity of the center and about 10 mm from the edge of the fabric 120 there is an opening 138 to receive the wearer's thumb. In this configuration, the sheet 120 forms the tubular member 102 and zone 134 of different fabric forms the banner 104. The banner 134 has a set of attachment means i.e. Velcro® or snaps 132 along the edge of 136 interchangeably attached for the purpose of engaging attachment means 130 and thus attaching the banner 134 to the tubular member. The banner can be tucked through the opening into a space created between the tubular member 120 and the skin on the back of the wearers hand for storage. Further, the banner can be tucked through the opening formed between the first and last attachments of set 126 and 128. The banner can be narrower 10-15 mm on both sides so that it is easier to tuck in.

In FIG. 1C and FIG. 1D a single sheet of fabric 140 is provided with two opposing lateral edges 143, and 149. The fabric is provided with four sets of attachment or closing means, such as snaps, buttons, etc. The first set 142 is disposed along edge 143. The second set of closing means 144 is disposed on the fabric in the proximity of a longitudinal line between the index and middle finger on the back of the right hand of the potential wearer. The third set of closing means 146 is disposed on the fabric in the proximity of a longitudinal line between the little and ring finger on the back of the right hand of the potential wearer. The fourth set of closing means 148 is disposed along edge 149 and thus defining zones 152, 154 and 156. By folding or rolling over the fabric, zones 152, 154 and 156 form the tubular member 102. First, attachment set 144 engages the attachment set 148. Second, the attachment set of 142 engage the attachment set 146 and thus forms the tubular member 102. Zone 152 overlap zone 156 and therefore forms a pocket for storing the banner 150 when not in use. In the proximity of one third of the fabric from side 143 and about 10 mm from the edge of the fabric there is an opening 160 to receive the wearer's thumb. FIG. 1C displays another set or attachment means 164 along the outside face of the fabric 140 and about 5 mm from attachment set 146. Attachment 164 may be i.e. a continuous or interrupted Velcro®, or snap buttons along the set of attachments 146 that may be interchangeably or continuously placed for the purpose of engaging attachment means 162 a continuous or interrupted Velcro® on fabric 150 and thus attaching 104 the banner, flag or pennant. Fabric 140 forms the tubular member 102 and fabric 150 forms the attached banner 104. The banner can be formed and tucked into the created pocket as described above.

The arm cover shown in FIG. 1B, FIG. 1C, FIG. 1D, can be worn on the right or left hand interchangeably. When the arm cover with banner is worn on the right arm, hand, the i.e. snap closing buttons of FIG. 1B are on the back portion of the arm, hand, along the extended longitudinal line approximately between the ring finger and the little finger. When the same arm cover with the banner is worn on the left hand the i.e. snap closing buttons of FIG. 1B are on the inside of the arm, palm approximately along the extended line between the ring finger and little finger. When the arm cover with banner FIG. 1C is worn on the right arm, the i.e. snap closing buttons of FIG. 1C are on the back portion of the arm and hand. Further, the created cavity for storing the banner is approximately on the extended longitudinal line between the index finger and the little finger. When the same arm cover with the banner is worn on the left hand the i.e. snap closing buttons of FIG. 1C are on the inside of the arm, palm of the hand, approximately along the extended line between the index finger and the little finger. Wearing the arm cover with the banner, with snap buttons and/or other means of attachment and the cavity created for the banner on the back of the hand and arm is preferred for comfort and safety reasons.

The various elements of article 100 can be made from different types of fabrics as well. The fabrics of the accessory could be knit, woven or unwoven materials. Many different combinations of fabrics, materials and colors may be selected. In some embodiments of the invention discussed below in conjunction with FIGS. 1-11, the tubular member 102 extends from the elbow to the base of the fingers and partially covers the palm, and/or the back of the wearer's hand. For these embodiments, the accessory is made of at least two or several pieces of fabric that are cut and then sewn, attached together with different attachment means taking into account safety and comfort of the potential wearer.

The banner 104 may be used to present a national flag, pennant, team's or organization's logo, etc. If a nation flag consists of two or three colors, then the here said accessory especially on the back of the hand is made using two or more fabrics of the respective colors. The two or more colored fabrics are sewn or joined together to form the accessory elements described above. If there are two colors chosen for the article than formed line 106 is just about in the middle of the back of the hand. However, it can be also formed along the extended longitudinal line between the ring finger and the little finger or any part on the back of the arm and hand suitable for cutting the fabric based on the contours of human hand and in line for a manufacturing desire. In a different configuration a slit may be provided for forming a pocket-like opening with a 3-5 mm wide fabric overlap to cover the slit.

Suitable fabric for the manufacturing of the arm cover may be any one or a combination of the following: Jersey fashion knit of 94% polyester and 6% spandex; Santa Barbara 100% polyester mixed fibers; Pacific Stretch 92% polyester and 8% spandex; Diana knit prints 90% polyester and 10% spandex; Danielle Knits 100% mixed fiber; or other similar fabrics available for the accessory may be pre-manufactured print with flags printed on those fabrics in order to accommodate the cutting of the fabric. The fabric of 102 for the tubular member is a combination of fibers and spandex to ensure that the fabric closely but comfortably fits the contours of the wearer's arm, hand, wrist and bases of the fingers. For the palm part of the accessory a composition of fabric mentioned above with a variety of colors is suitable. Preferably, having a mesh weaving to accommodate air flow in order to reduce sweating of the palm in warm weather is favored.

Preferably the banner is made of different fabric than the tubular member. For example, the banner may be of 100% light silk or any 100% light polyester fiber with little or no wrinkling suitable for dyeing or printing the national, sports team, event flag, coat of arms and words, alphanumeric characters on successfully. It is imperative that the chosen fabric is light and flies in the air with a small arm motion or light movement of air. Suitable fabrics are i.e. Cameo Prints 100% polyester; or 100% silk Georgette; 100% polyester Georgette, or 100% polyester or silk Charmeuse, or 100% polyester Chiffon are best for 104 banner, flag, pennant. Other suitable fabrics may be considered by the potential manufacturer.

The size of the banner, flag or pennant should be from about 90 mm wide to 300 mm wide and from about 110 mm long to 400 mm long for the large size to allow for proper accommodation of the proportions of the flag. However the length of the flag, banner and/or pennant should not exceed the length of the wearers elbow bone for safety reasons. On a stretched out arm above the wearers head the banner should touch only the wearer's hair not to obstruct the wearer's view and/or vision. The accessory can be manufactured in all children's, junior and adult sizes and the banner should be sized accordingly.

FIGS. 2-11 show various embodiments and configurations of the invention.

Figure 2:
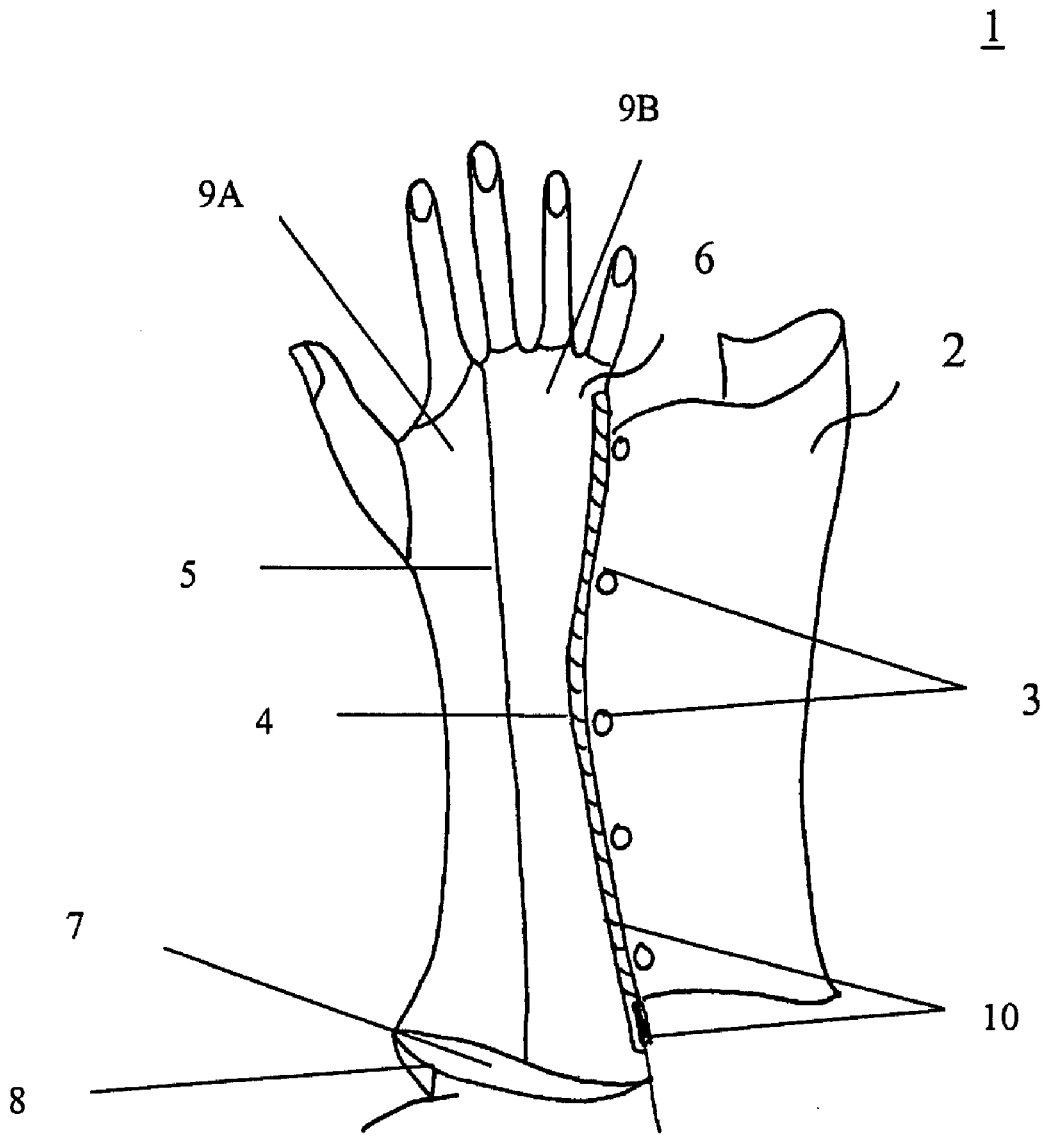
FIGS. 2-11 show various embodiments of the arm cover.

FIG. 2 shows an arm cover 1 with a tubular member 6. The back hand portion of the tubular member 6 is made from two pieces of fabric 9A and 9B with a longitudinal cut and stitch 5. Another longitudinal cut 4 is to accommodate the opening for a cavity/pocket and extends along the longitudinal line of the little finger of the wearer. The tubular member 6 shows a lower opening 8 at the elbow through which a lining of a pliable fabric 7 is shown. The pliable fabric may be a lining suitable for inside layer preferably cotton, polyester and spandex combination to form a pocket or cavity. This pocket is accessible through a slit formed by a longitudinal opening and closed by zipper 10 for storing or releasing the banner/flag 2. The banner 2 is attached to the tubular member with snap buttons 3 or other means of attachment. Alternatively, the portion 9B of the arm cover 1 starting from the palm, continuing to 9A overlaying the back of the wearer's hand can be made of a mesh fabric to prevent warming or sweating of the palm in hot weather.

Figure 3:
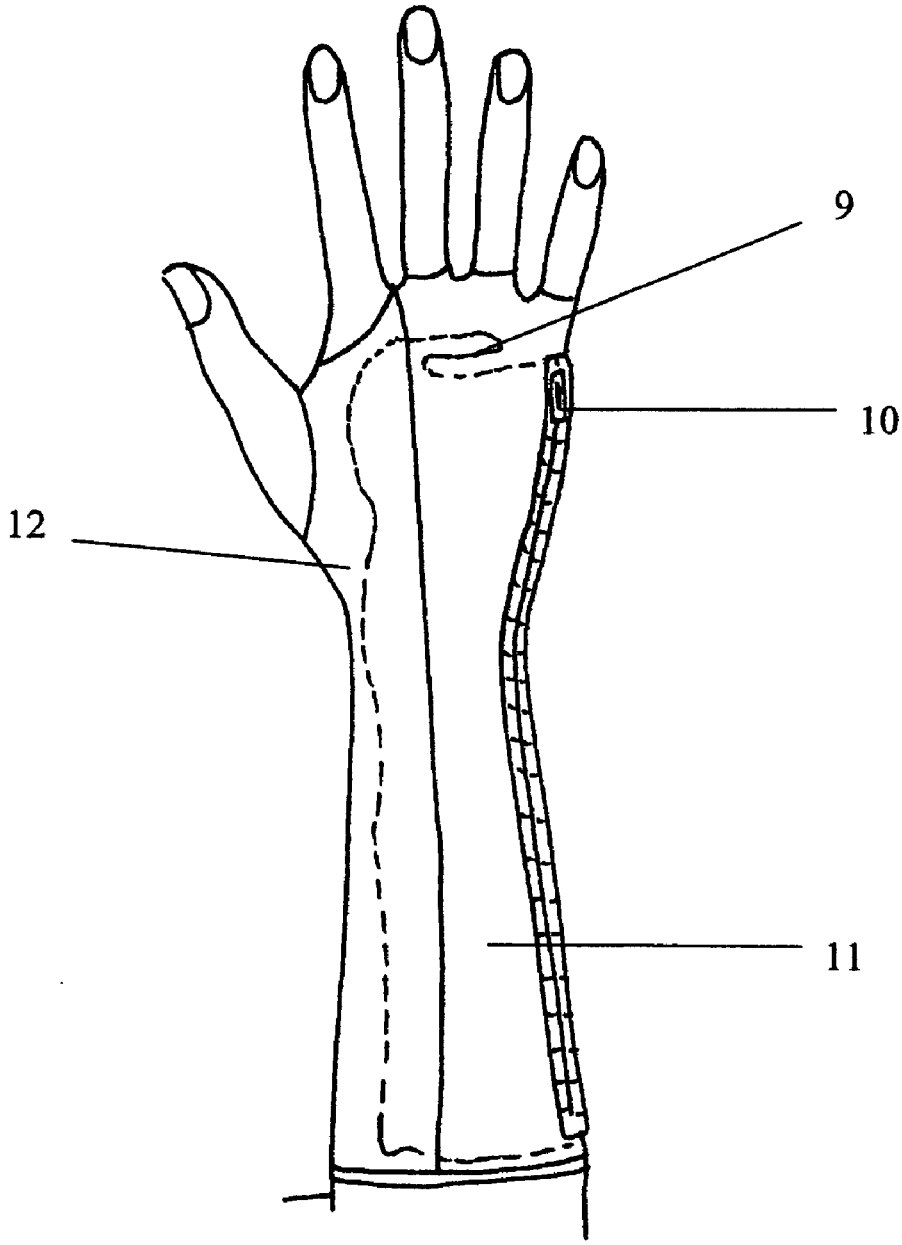

FIG. 3 shows an arm cover 11 similar to the one in FIG. 2 with the banner/flag/pennant 9 tucked into the cavity, with zipper 10 closed and extending over back of the hand 12.

Figure 4:
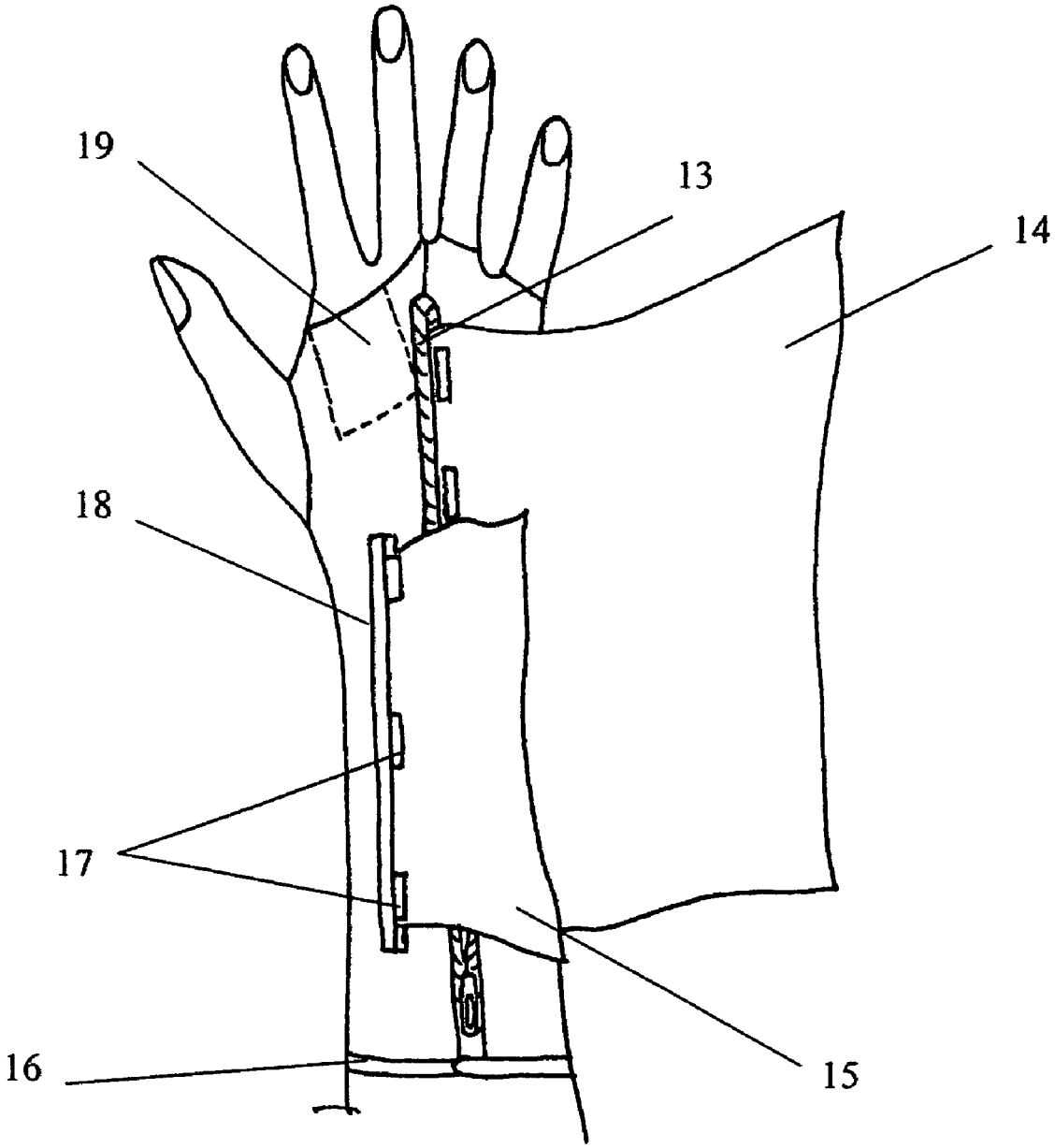

FIG. 4 In the embodiment arm cover is shown having two pockets 13 and 18 each being selectively closed with an optional closing means such as a zipper 13 or Velcro® 17. Each pocket holds a banner/flag/pennant 14, 15, respectively. The shorter pocket 18 could be used for banner 15 with a country name, logo, coat of arms, word, slogan etc. The longer pocket 13 is for a national or team flag, pennant or banner 14. A strap Velcro® or appropriate fastening means 16 may be used to comfortably fit the arm cover to the forearm of the wearer to prevent sliding. A small pocket 19 opening is provided for storing small items, such as a ticket stub, etc.

Figure 5:
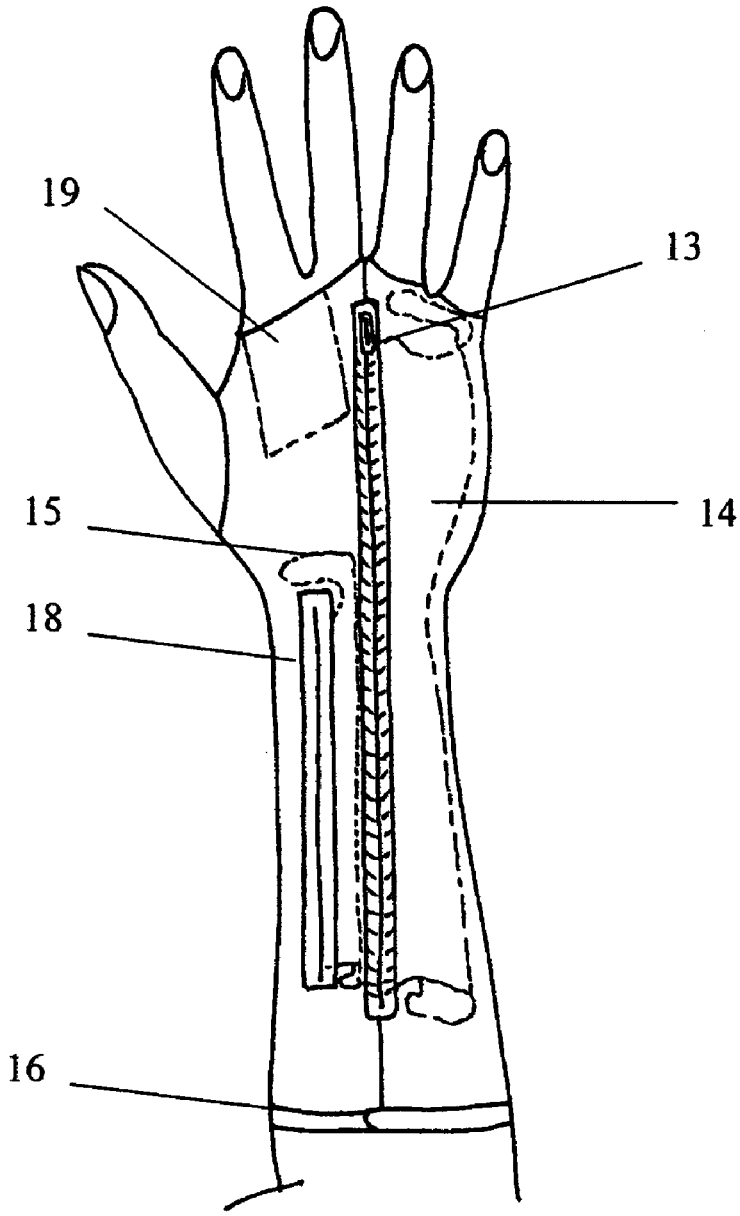

In the embodiment of FIG. 5, an arm cover similar to the one in FIG. 4 is shown with banners 14, 15 tucked into the respective pockets 13 and 18 along with a small pocket opening 19 provided for storing small items and a strap Velcro® or appropriate fastening means 16 may be used to comfortably fit the arm cover to the forearm of the wearer to prevent sliding.

In all of the embodiments, the length of the zipper, zip lock, slit or pocket may extend from the proximity of the knuckle of the base of the middle finger to the end of the accessory, near the elbow of the wearer. The pocket may be shorter, smaller depending on the length of the respective banner. The invention may have an adjustable Velcro fastener to fit most sizes at the elbow of the accessory.

Figure 6:
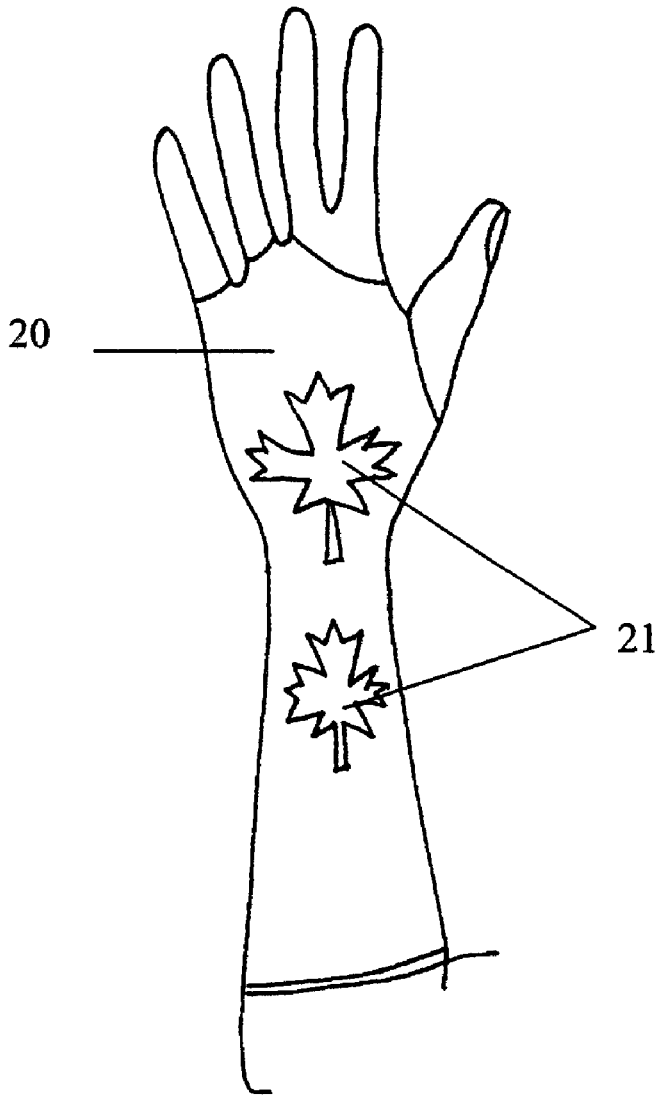

FIG. 6 shows a palm, inside of the arm view of the embodiments of Figs. For the palm and the inside arm 20 portion of the arm cover a mesh like woven fabric is preferred. Furthermore, the palm/front portion of the arm cover may be provided with one or more images 21 including logos, seals, coats-of-arms, and the like.

Figure 7:
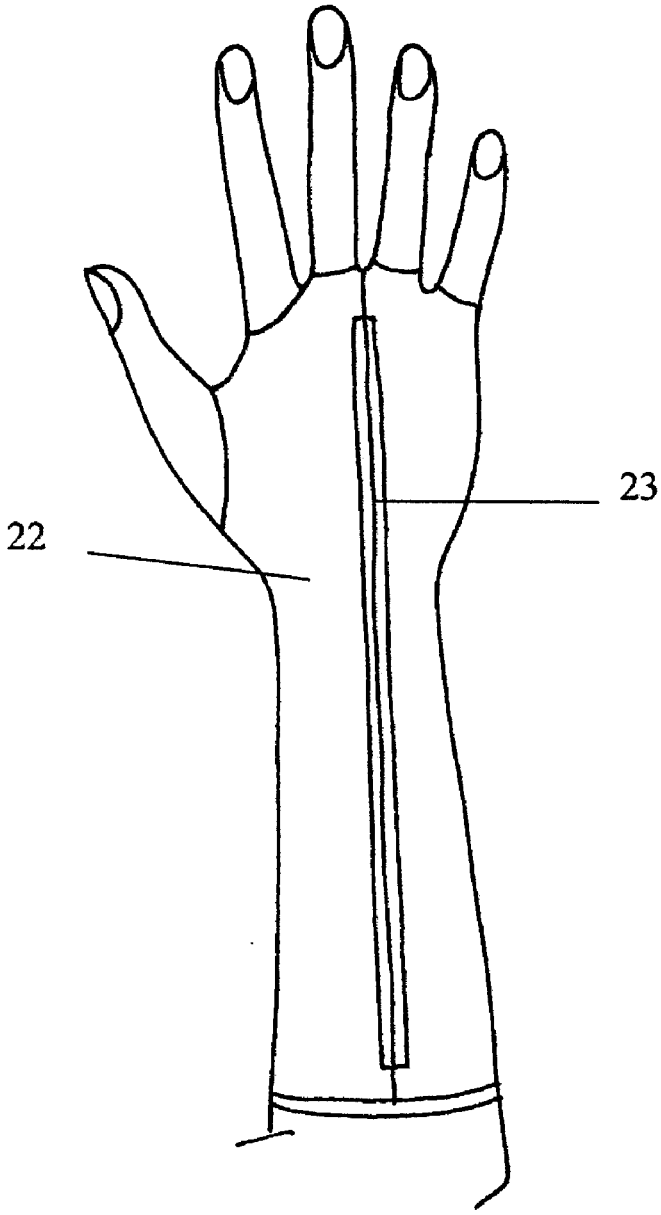

FIG. 7 shows another embodiment of an arm cover 22 with only one pocket 23 without a zipper or other closing means.

Figure 8:
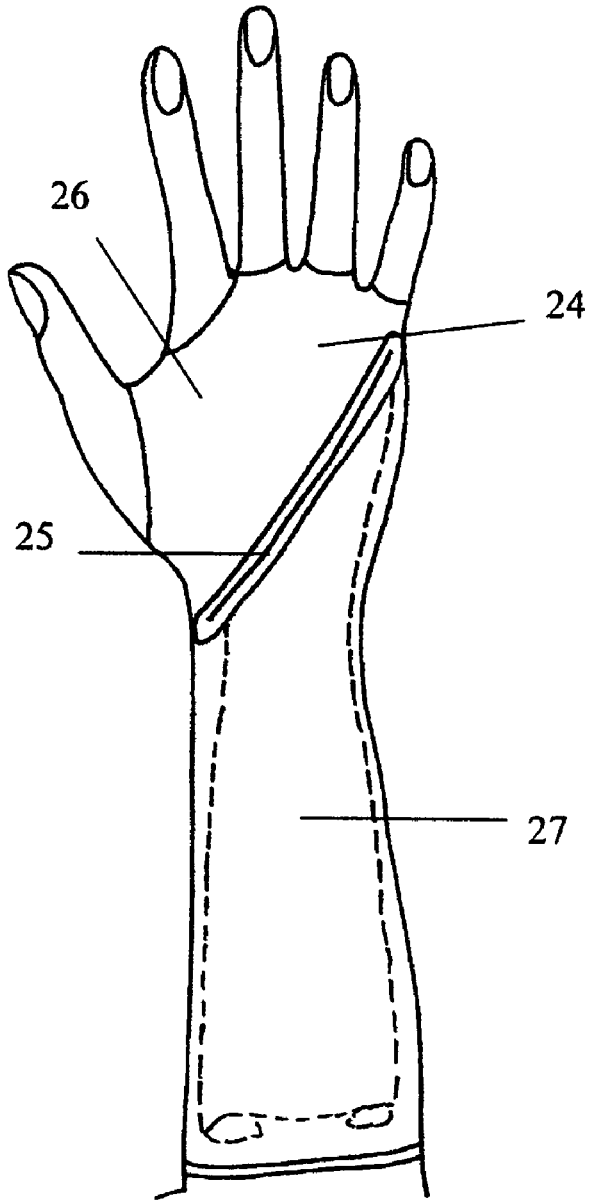

FIG. 8 shows an arm cover 24 having a slanted or diagonal slit 25 rather then a longitudinal one as shown in previous embodiments. The slit is disposed adjacent to the hand portion 26 of the arm/hand with a banner 27 tucked in.

Figure 9:
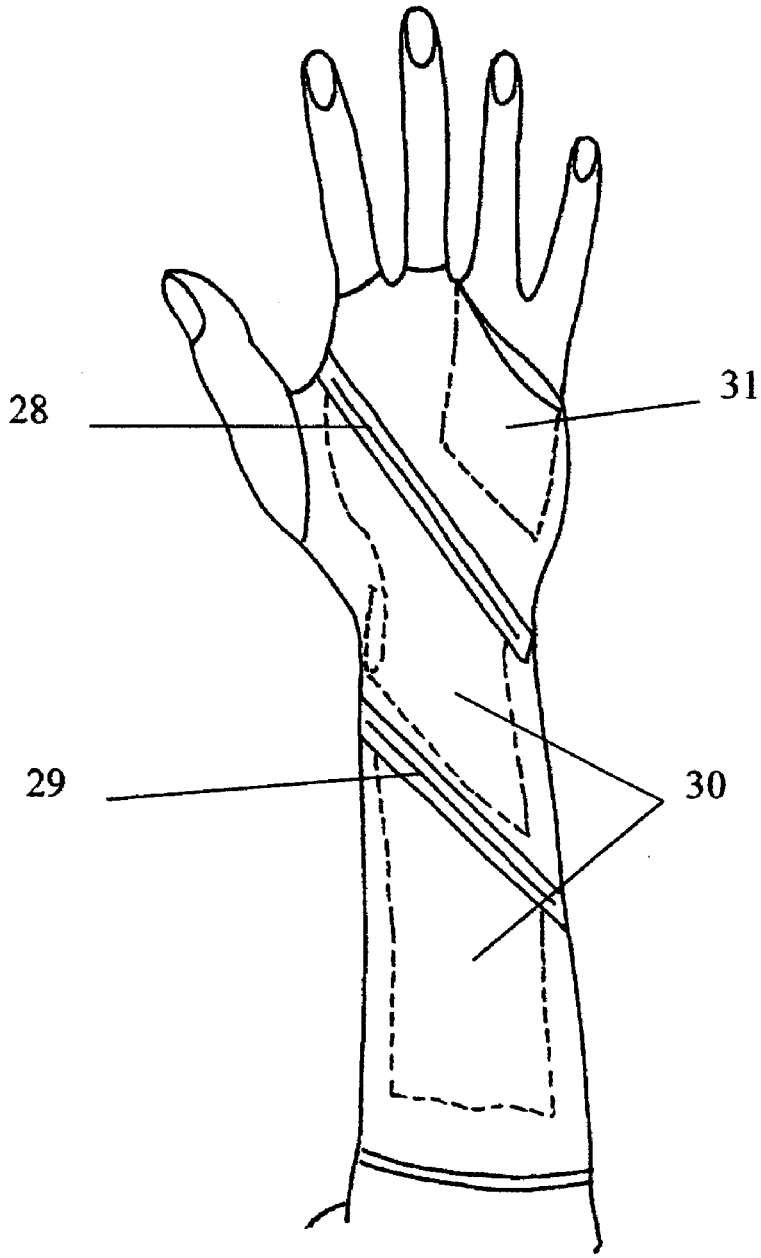
Figure 10A:
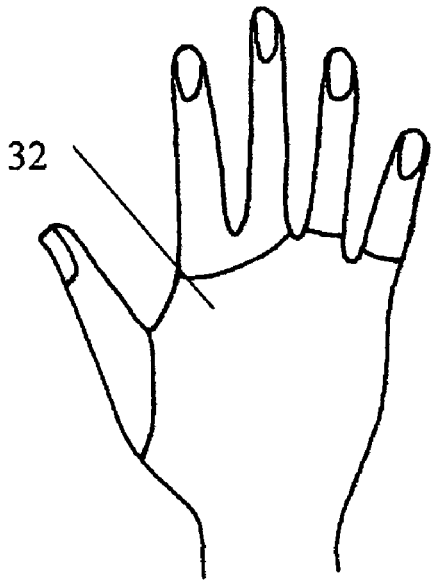
Figure 10B:
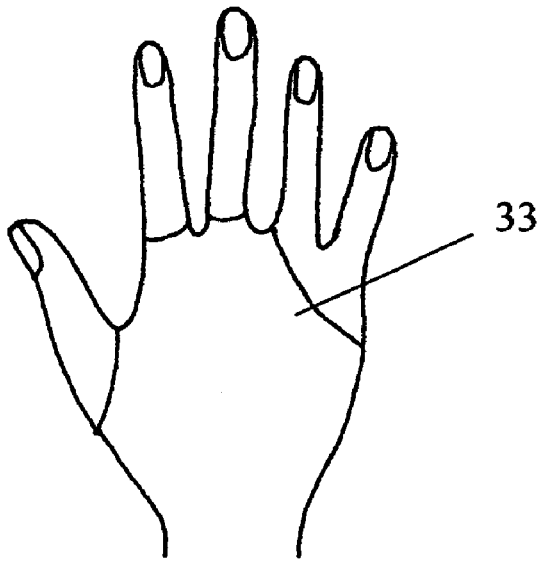
Figure 10C:
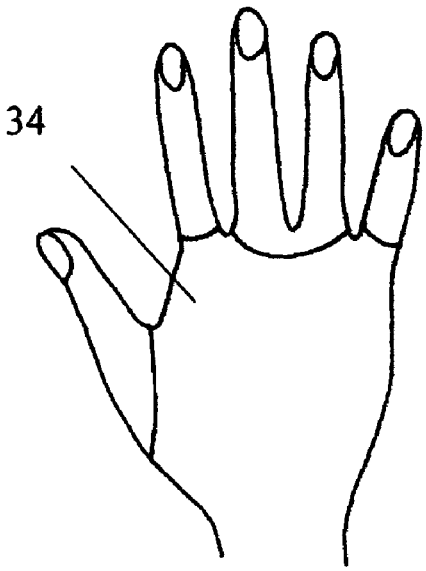
Figure 10D:
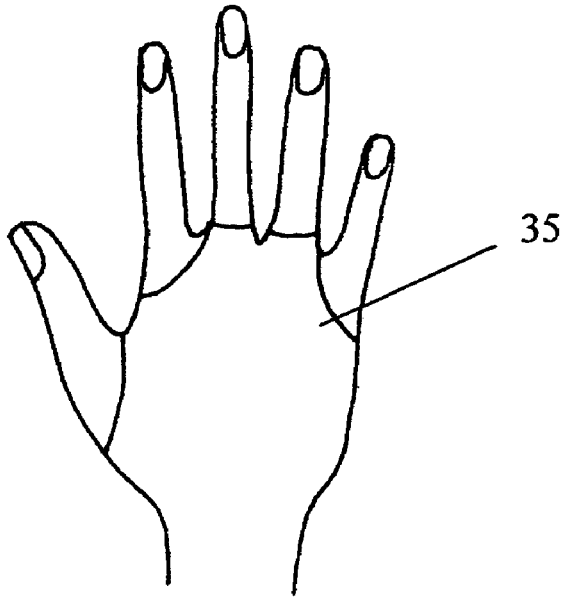
Figure 11A:
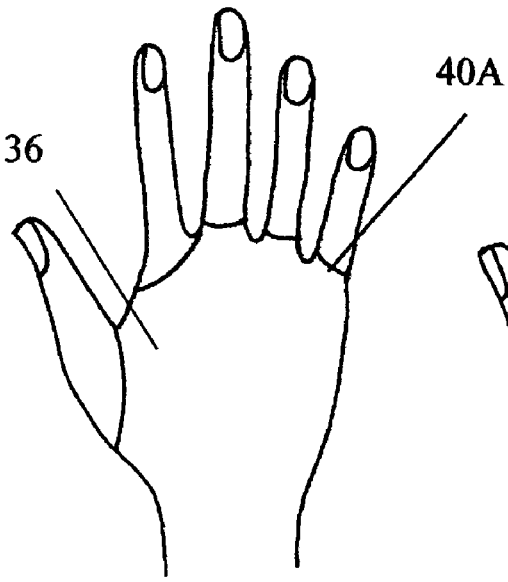
Figure 11B:
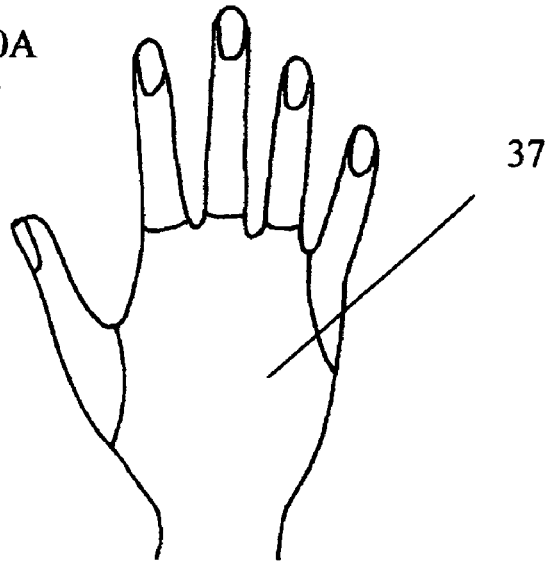
Figure 11C:
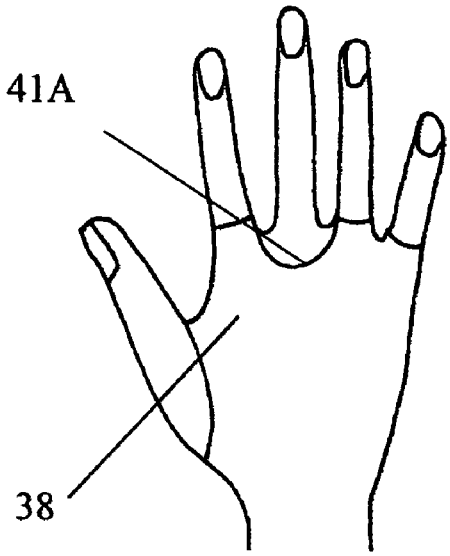
Figure 11D:
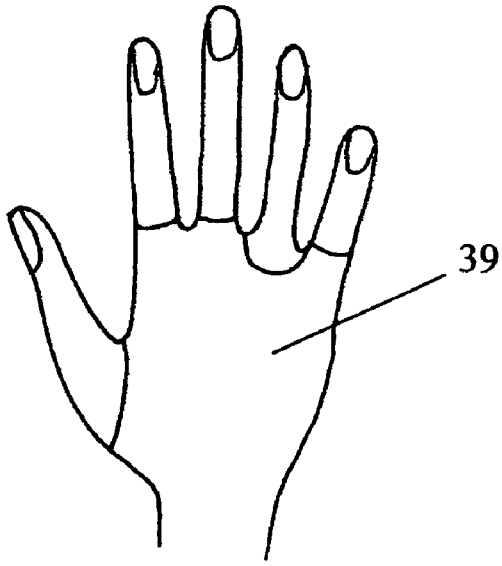

FIG. 9 shows an arm cover with several diagonal slits 28, 29 oriented in an opposite direction to the one in FIG. 8. Each slit leads to a respective pocket 30 for a banner and a pocket 31 for small items like a ticket or other items. Each pocket may be provided with a closing means such as a zipper and the like.

As previously discussed, preferably the arm covers with banner here described extend to but do not necessarily cover the fingers. Therefore, the arm covers are provided with various sized and shaped finger openings to allow one, two or more of the fingers to extend there through. FIGS. 10A-10D and 11A-11D show arm covers 32, 33, 34, 35, 36, 37, 38 and 39 with various combinations of cuts or openings for thus purpose. The cuts may be provided at the base of the fingers, such as at 40A in FIG. 11A or may be curved as at 41A in FIG. 11C.

The invention can be made of one continuous knit with an opening for the banner, the thumb and a banner attached to it as described above.

Obviously numerous modifications may be made to this invention without departing from its scope as defined in the appended claims.

I claim:

1. An arm cover with an integral banner comprising: a tubular member sized and shaped to fit over the arm of a person; and a banner having at least one straight edge, said banner being attached to said tubular member by said straight edge along a longitudinal line disposed adjacent to and within a longitudinal slit on said tubular member; and an inner liner attached to said tubular member, wherein said inner liner and said longitudinal slit cooperate to form a pocket for selectively storing said banner within said tubular member.

2. The arm cover of claim 1 further comprising a fastening element for fastening said banner to said tubular member.

3. The arm cover of claim 2 wherein said fastening element provides a releasable fastening for said banner.

4. The arm cover of claim 1 wherein said longitudinal slit is sized and shaped to selectively receive said banner inside said tubular member for storage.

5. The arm cover of claim 1 wherein said tubular member is sized and shaped to extend and at least partially cover the wearer's palm.

6. The arm cover of claim 5 wherein said tubular member has an outer portion formed with a cutout accommodating one or more of the wearer's fingers.

7. An arm cover for displaying flags, logos, emblems and the like, said arm cover comprising:

a tubular member sized and shaped to be pulled over the forearm of a wearer, said tubular member being made of a sheet of fabric forming a first and a second opening, said second opening being disposed at the palm when the tubular member is worn; and a banner having an attachment edge for attaching the banner to said tubular member; and a longitudinal slit in said tubular member, wherein said longitudinal slit is sized and shaped to selectively receive said banner for storage;

said attachment edge of said banner being attached to said tubular member adjacent to and within said longitudinal slit.

8. The arm cover of claim 7 further comprising an attachment member attaching said banner to said tubular member along said attachment edge.

9. The arm cover of claim 8 wherein said attachment member is structured and arranged to selectively release said banner.

10. The arm cover of claim 7 wherein said tubular member is formed with a cavity, wherein said longitudinal slit provides access to said cavity.

11. The arm cover of claim 10 wherein said cavity is disposed on said tubular member to receive said banner.

12. The arm cover of claim 11 further comprising a closing member selectively closing said cavity.

13. The arm cover of claim 7 wherein said tubular member is formed with a first and a second slit and a first and a second banner, each slit defining a cavity receiving a respective banner.

14. The arm cover of claim 7 wherein said longitudinal slit defines a pocket.

15. An arm cover comprising:

a tubular member having a first and second opening, wherein said tubular member is constructed and arranged to fit over the arm of a wearer with a first cavity receiving the wearer's arm;

a longitudinal slit;

a banner having an attachment edge that is selectively attached to said tubular member, said attachment edge being disposed in the first cavity adjacent to said longitudinal slit; and an inner liner attached to an inner surface of said tubular member, wherein said inner liner and said longitudinal slit cooperate to form a pocket for selectively storing said banner within said tubular member.

* * * * *